US006758577B2

(12) United States Patent
Wu

(10) Patent No.: US 6,758,577 B2
(45) Date of Patent: Jul. 6, 2004

(54) DO-IT-YOURSELF LAMP STRUCTURE

(76) Inventor: Wen-Chang Wu, No. 10, Lane 191, Hsi Hsin Street, Chuang Ya Tsun, Hsin Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 10/196,368

(22) Filed: Jul. 17, 2002

(65) Prior Publication Data

US 2004/0012972 A1 Jan. 22, 2004

(51) Int. Cl.[7] ..... H01R 33/00

(52) U.S. Cl. ..... 362/226; 362/414; 439/289; 439/746

(58) Field of Search ..... 362/226, 414; 439/289, 354, 745, 746

(56) References Cited

U.S. PATENT DOCUMENTS 4,797,798 A * 1/1989 Schumaker et al. ..... 362/413
5,034,865 A * 7/1991 Sonneman ..... 362/226
6,149,472 A * 11/2000 Endo et al. ..... 439/745
6,280,261 B1 * 8/2001 Sakurai ..... 439/746
6,475,037 B1 * 11/2002 Harting et al. ..... 439/745
6,508,669 B2 * 1/2003 Wang ..... 439/598
6,655,816 B2 * 12/2003 Wu ..... 362/226

* cited by examiner

*Primary Examiner*—Alan Cariaso
*Assistant Examiner*—Jacob Y. Choi
(74) *Attorney, Agent, or Firm*—Troxell Law Office PLLC

(57) ABSTRACT

The present invention relates to a do-it-yourself (DIY) lamp structure, mainly comprising of a base, a lamp rod on the base, a coupling hole on the base, and an embedded groove protruded from the lateral side of the opening, so that the lamp rod is inserted into the opening and the embedded groove for the assembly; a bracket is extended outward from the rim in corresponsive to the position of the embedded groove of the base such that when the lamp rod is inserted, the bracket will be pressed in advance, and after the lamp rod passes through the embedded groove, the bracket can be flipped out appropriately and latched into the embedded hole of the base to fix the lamp rod and base in a secured position. Therefore, regardless of the package, transportation, or storage, the lamp rod and base can be detached in order to reduce the volume for the transportation and storage. After the user has bought the lamp, the user does not need any tools such as screwdriver to complete the assembling, which is convenient for quick installation.

14 Claims, 10 Drawing Sheets

FIG. 1-A

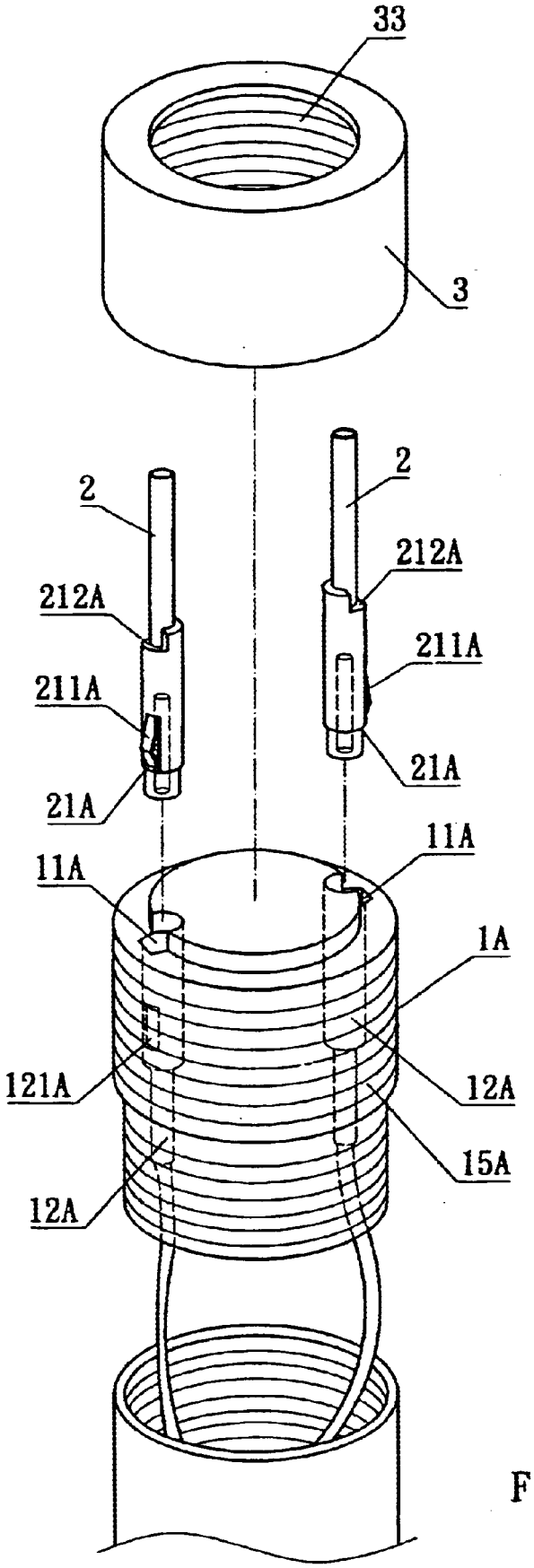
FIG. 5-B

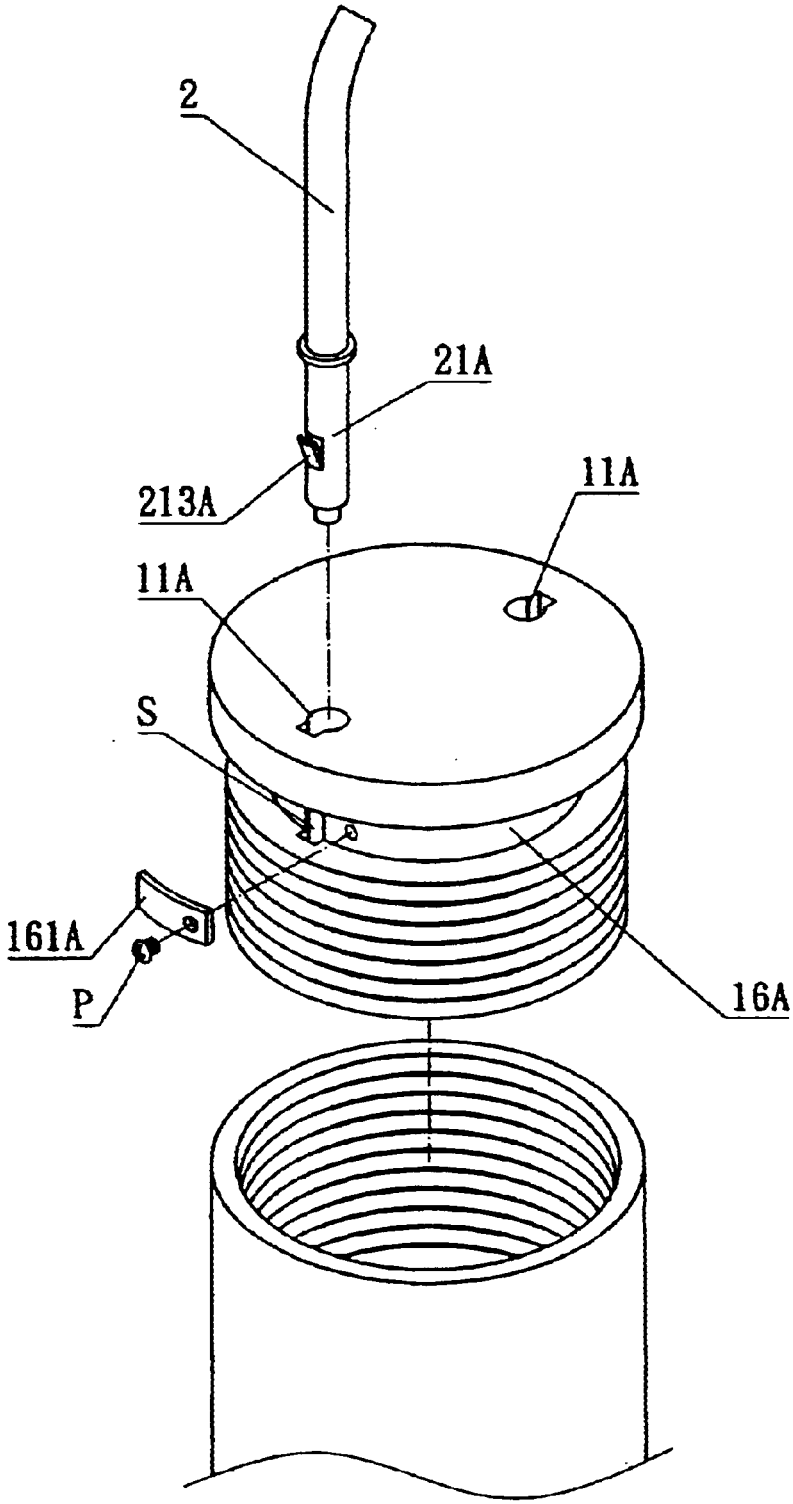
FIG. 5-C

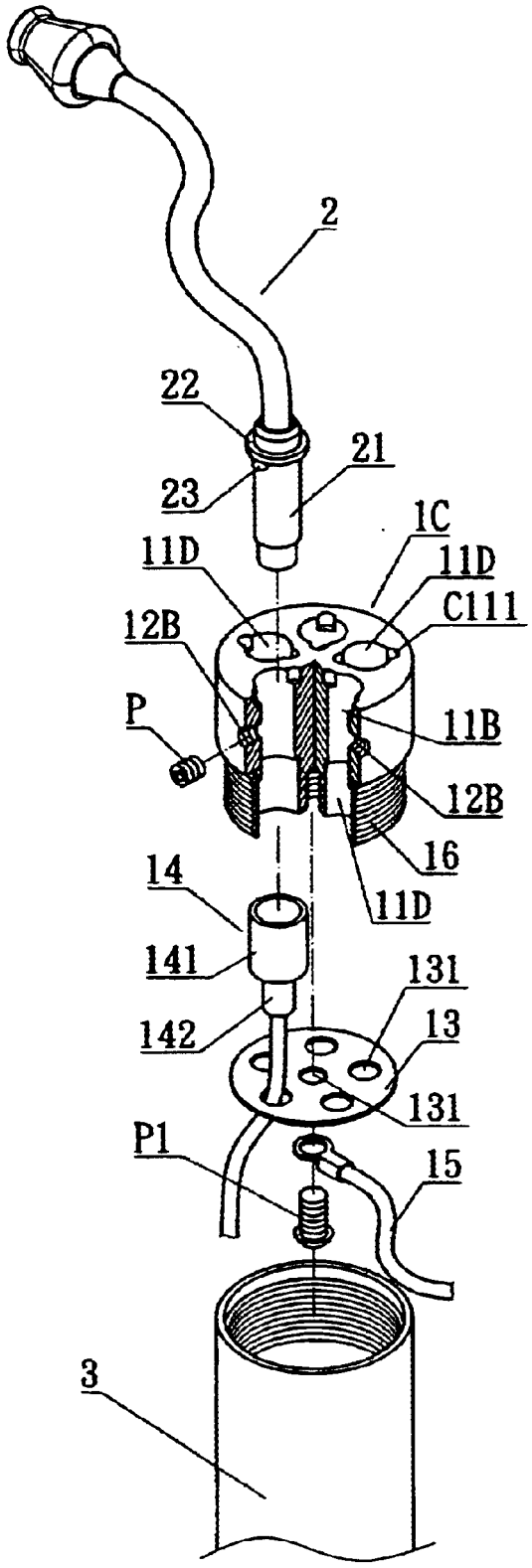
FIG. 6-B

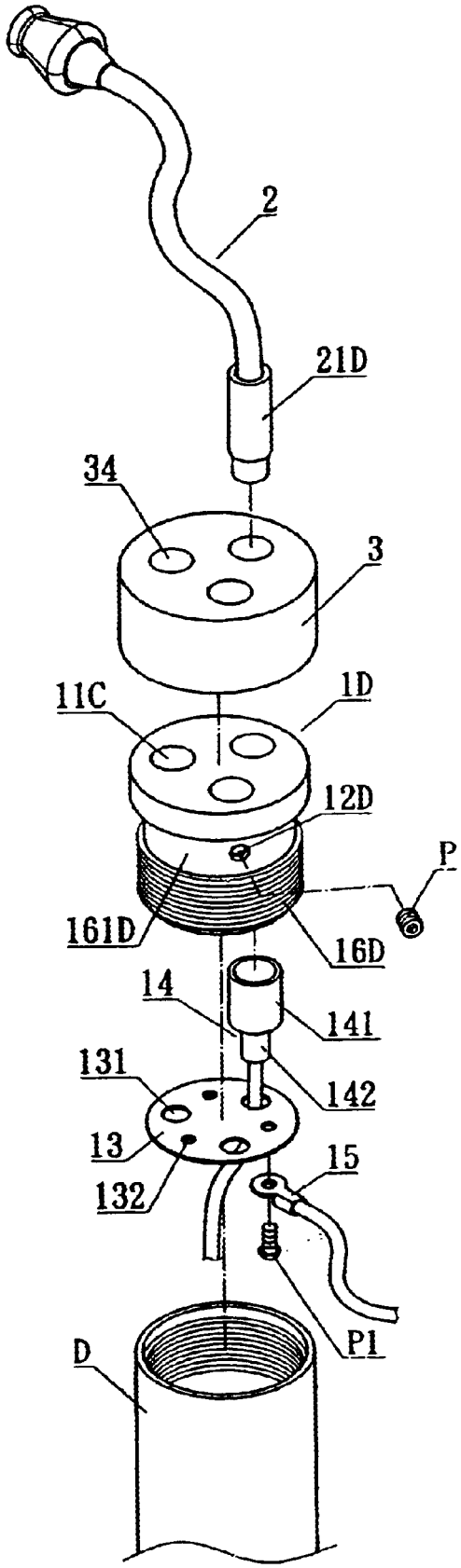
FIG. 6-C

DO-IT-YOURSELF LAMP STRUCTURE

BACKGROUND OF THE INVENTION (a) Field of the Invention

The present invention is related to a lamp structure, more particularly to a do-it-yourself (DIY) lamp structure that uses a coupling hole, an embedded groove on the side of the coupling hole working with an embedded groove protruded around the periphery of the small stairway-like hole of the base and a latching hole leading to the outside, and fixed to the corresponsive position where the embedded groove is coupled. A bracket is extended outward from the rim in corresponsive to the position of the embedded groove of the base such that when the lamp rod is inserted, the bracket will be pressed in advance, and after the lamp rod passes through the embedded groove, the bracket can be flipped out appropriately and latched into the embedded hole of the base to fix the lamp rod and base in a secured position.

Therefore, the lamp rod and base can be detached in order to reduce the volume for the transportation and storage, and make it easier for the DIY.

(b) Description of the Prior Art

In the prior-art coupling structure of the base and the lamp rod either for wall lamps, table lamps, or floor lamps, screw bolts and nuts are used for the coupling. However, the assembling by these bolts and nuts may damage the finished goods easily, and it also needs tools (such as wrench or screwdriver, etc.) for the assembling, which is troublesome and not suitable for the DIY assembling. Therefore, the manufacturer needs to assemble the wire connection box and the lamp rod before selling the lamp. It increases the volume for the transportation, and thus causes a higher cost. In view of the aforementioned shortcomings of the prior art, the present inventor herein with many years in the related field enhances the structure of the lamp and finally invents the present invention.

SUMMARY OF THE INVENTION

The primary purpose of the present invention is to provide a do-it-yourself (DIY) lamp structure that uses a coupling hole, an embedded groove on the side of the coupling hole for accommodating the lamp rod; working with an embedded groove protruded around the periphery of the small stairway-like hole of the base and a latching hole leading to the outside, and fixed to the corresponsive position where the embedded groove is coupled. A bracket is extended outward from the rim in corresponsive to the position of the embedded groove of the base such that when the lamp rod is inserted, the bracket will be pressed in advance, and after the lamp rod passes through the embedded groove, the bracket can be flipped out appropriately and latched into the embedded hole of the base to fix the lamp rod and base in a secured position. Therefore, regardless of package, transportation, or storage, the lamp rod and base can be detached in order to reduce the volume for the transportation and storage, and after the user has bought the lamp, the user needs not to use tools for assembling the lamp, and thus making the DIY assembling much easier and faster.

BRIEF DESCRIPTION OF THE DRAWINGS

FIG. 5B is a diagram of a third preferred embodiment of the present invention.

FIG. 5C is a diagram of a fourth preferred embodiment of the present invention.

FIG. 6B is a diagram of a sixth preferred embodiment of the present invention.

FIG. 6C is a diagram of a seventh preferred embodiment of the present invention.

DETAILED DESCRIPTION OF THE PREFERRED EMBODIMENTS

Figure 1:
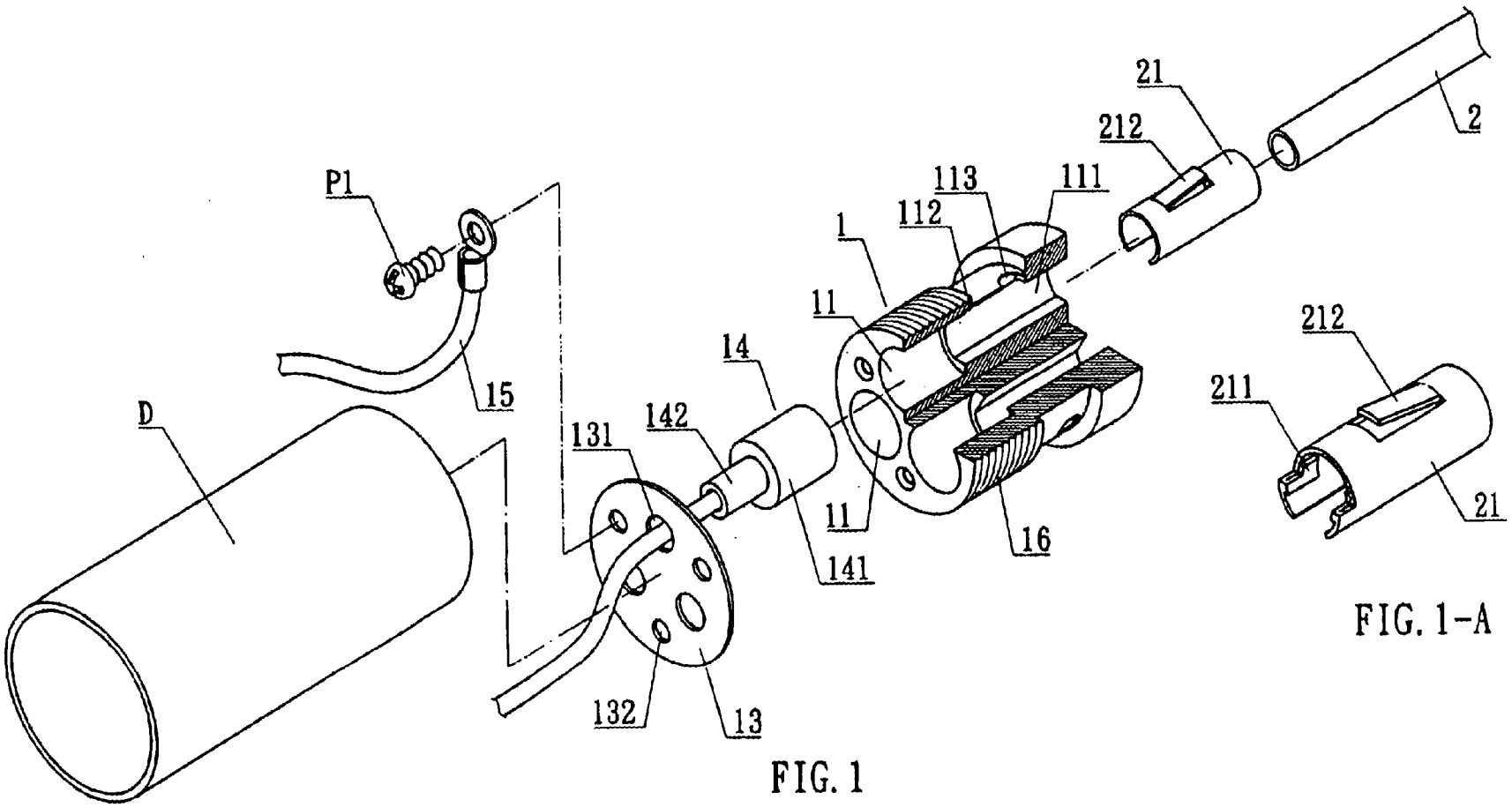
FIG. 1 is an explosive diagram of the present invention.
Figure 2:
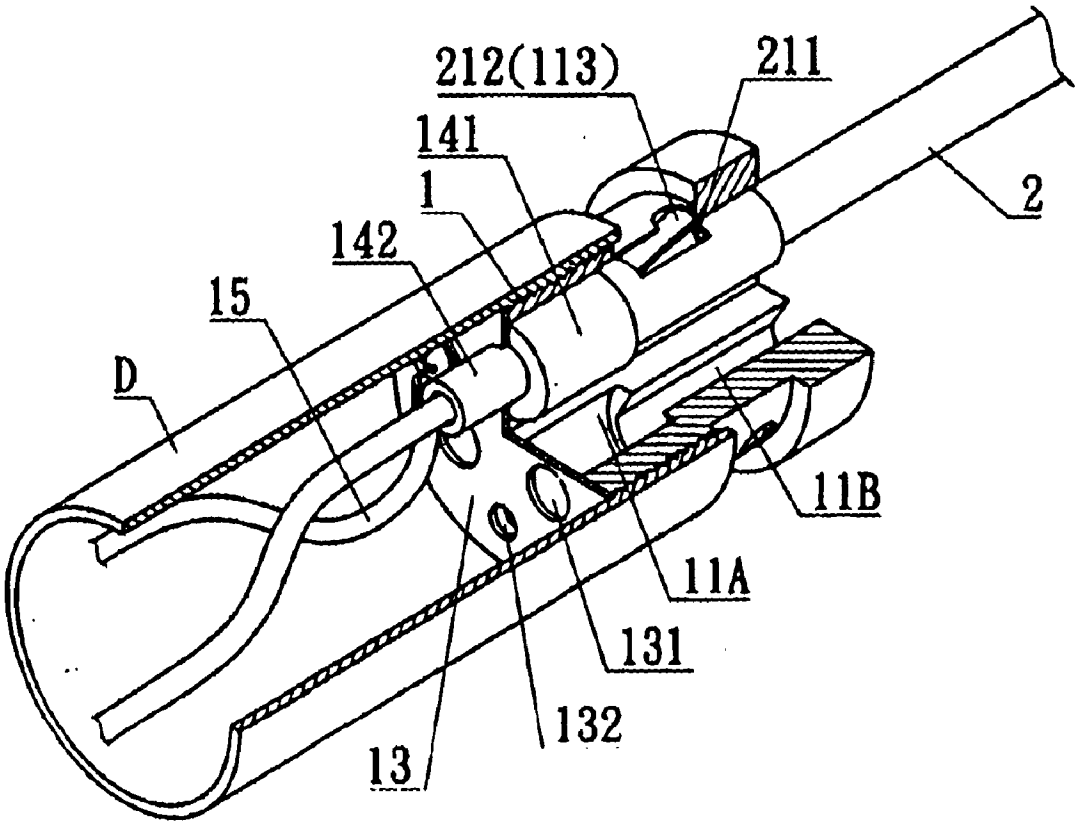
FIG. 2 is an assembly diagram of the present invention.
Figure 3A:
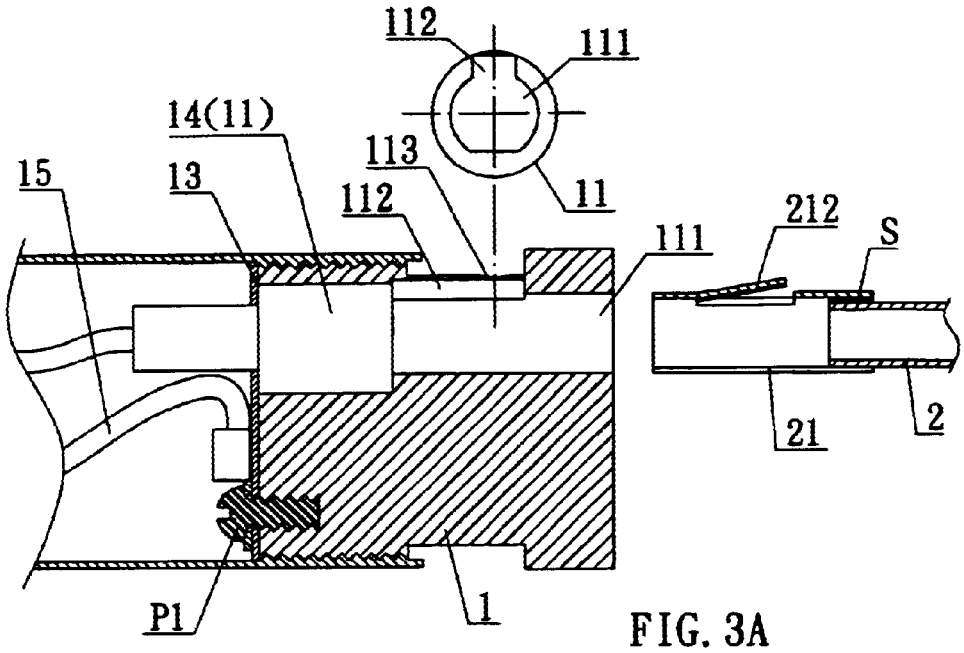
FIG. 3A is the cross-sectional diagram of the present invention before the installation of the lamp rod.
Figure 3B:
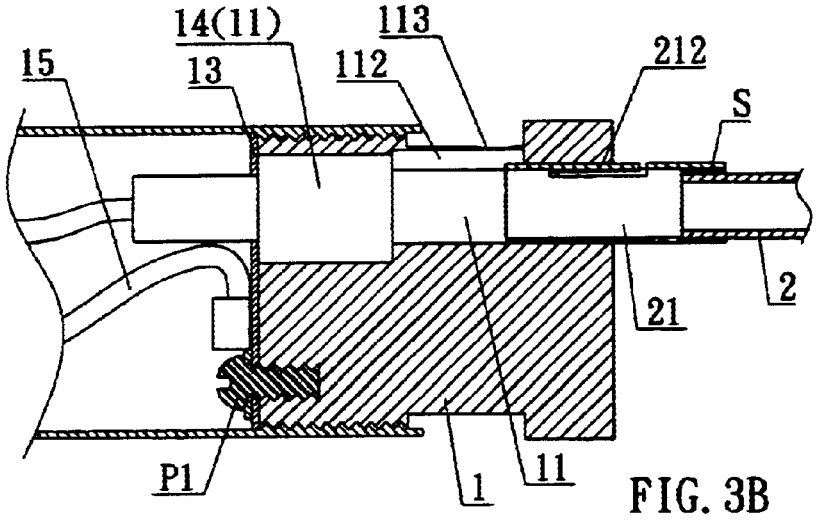
FIG. 3B is the cross-sectional diagram of the present invention during the installation of the lamp rod.
Figure 3C:
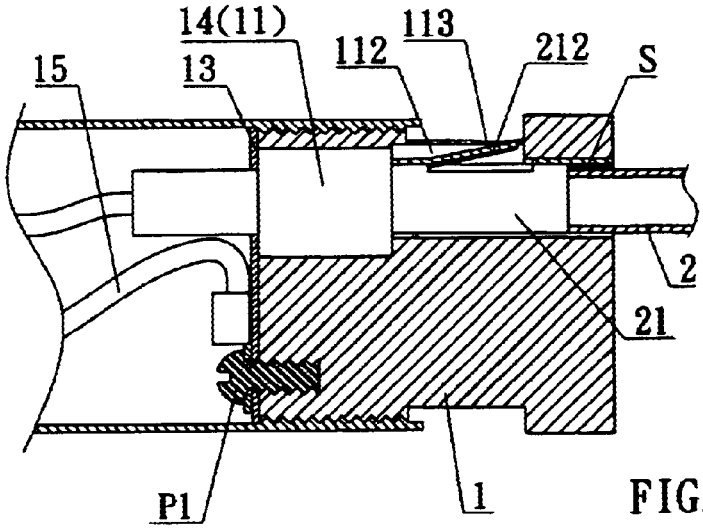
FIG. 3C is the cross-sectional diagram of the present invention after installation of the lamp rod.

Please refer to FIGS. 1 to 3 for the clear structural conditions of the present invention. The present invention comprises a base 1 and a hollow lamp rod 2 disposed on the base 1; wherein: the base 1 having an upper and a lower penetrating stairway-like hole 11, and a socket 14 being exactly inserted into a penetrating hole with larger stairway-like hole 11A for the positioning, and the head end of the lamp rod passes through the penetrating hole with smaller stairway-like hole 11B; and the smaller stairway-like hole 11B is substantially C-shaped, and an embedding groove 112 is disposed in the middle section of the rim, and a latching hole 113 penetrating to the outside is disposed on the embedded groove 112 for providing latching after the lamp rod 2 is inserted; a positioning disc 13 is coupled to the bottom of the base 1 by fixing it with screw bolt P1, a through hole 113 is disposed at the position corresponsive to the penetrating hole 11 of the base on the positioning disc 13, and a socket 14 is installed onto the through hole 131 in advance, and a securing hole 132 is disposed between the through holes 131 for securing a screw bolt P1 in advance to passing the ground line 15 through the bottom of the securing hole 132 of the positioning disc 13.

After the positioning disc 13 is fixed, the socket 14 with larger ring 141 that is located exactly in the penetrating hole 11, and the smaller ring 142 is protruded from the bottom of the positioning disc 13 to prevent the socket from falling off; working with the external screw thread section 16 disposed at the bottom section of the base 1. After the base 1, positioning disc 13, and ground line 15 are assembled, the external screw thread section 16 of the base 1 can be respectively fixed to the fixing tube D of the wall lamp, floor lamp, or suspending lamp according to the different needs of use.

After the base 1, positioning disc 13, and ground line 15 are assembled, the external screw thread section 16 of the base 1 can be respectively fixed to the fixing tube D of the wall lamp, floor lamp, or suspending lamp according to the different needs of use.

A fixing sleeve 21 having a pair of small stairway-like holes 111 of the base is soldered at the top of the lamp rod 2 to prevent lamp rod 2' from rotating, and the fixing sleeve 21 has a bracket 211 inwardly bent to both corresponsive sides at the is bottom of the fixing sleeve 21. When the lamp rod 2 is sleeved, the lamp rod 2 and the inner periphery of the fixing sleeve 21 forms a ringed space S by the partition of the bracket 211 for facilitating the soldering of the lamp rod and the fixing sleeve 21 as a whole in the space S. To cope with the position of the embedding groove 112 of the base 1 corresponsive to the fixing sleeve 21, a bracket 212 is bent outward towards the ring. When the bracket 212 is inserted into the lamp rod 2, it is compressed in advance, and after the bracket 212 is inserted, it will flip out to an appropriate extent to latch into the latching hole 113 of the base, such that the lamp rod 2 and the base 1 are fixed and the base 1 is electrically connected.

Figure 4:
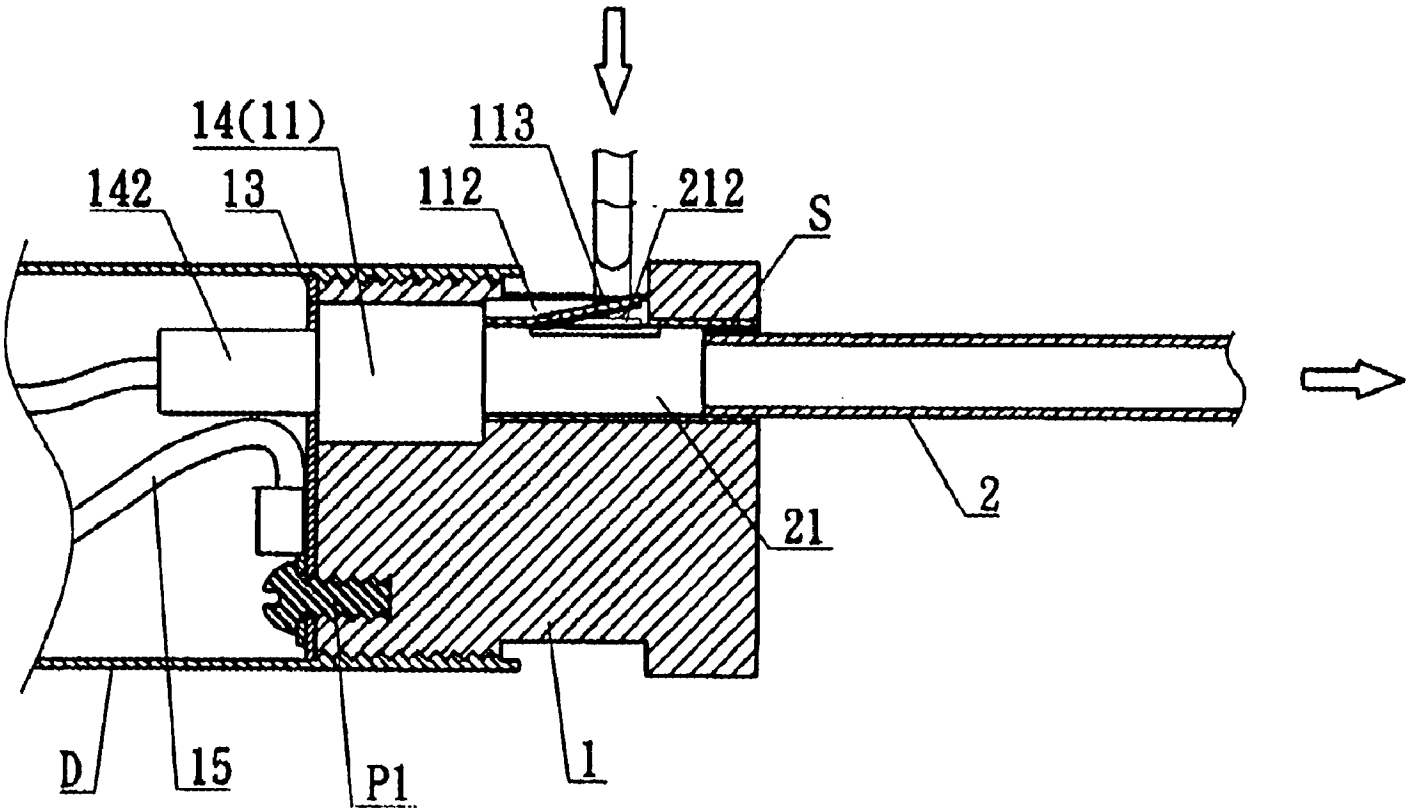
FIG. 4 is diagram showing the detachment movement of a preferred embodiment of the present invention.

Please refer to FIG. 4. If the user wants to pull the lamp rod 2 out from the base 1, the user can pass the tool through the latching hole 113 of the base first, and compress the bracket 212 latched inside the latching hole 113 to separated the bracket 212 from being latched to the latching hole 113 and the embedding groove 112 that provides a good way of pulling the lamp rod 2 out from the base. Such arrangement attains the function for easy, and convenient assembling and disassembling.

Figure 5A:
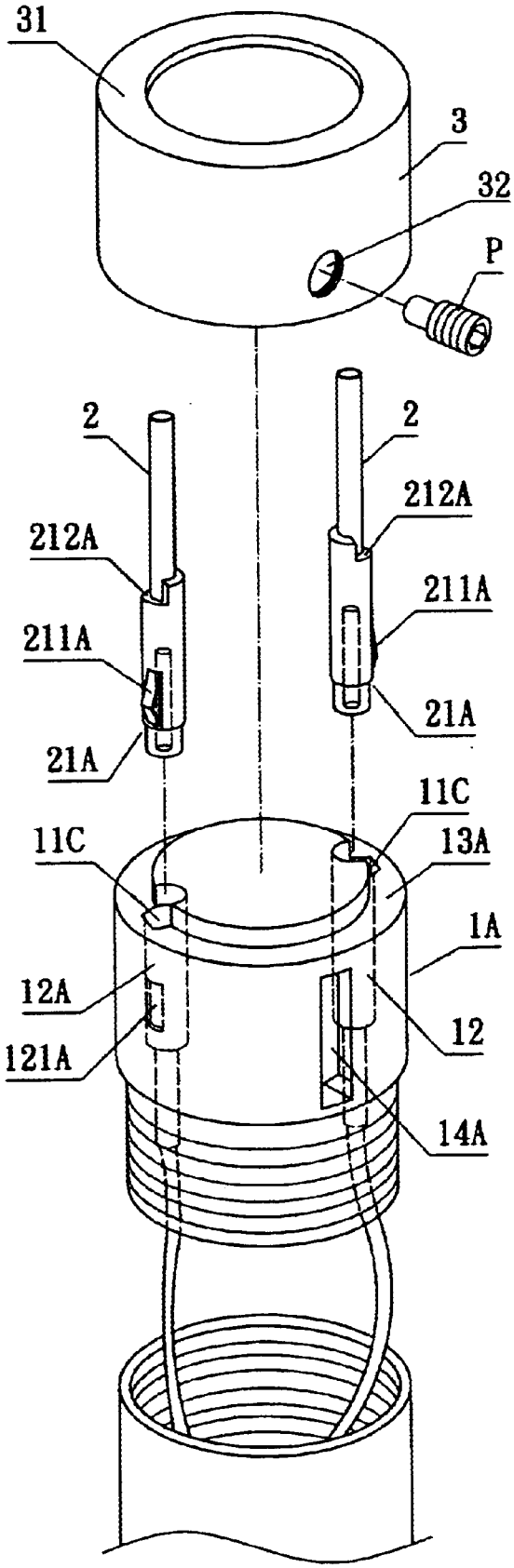
FIG. 5A is a diagram of a second preferred embodiment of the present invention.

Please refer to FIG. 5A for another preferred embodiment of the present invention. The base 1A has a stairway-like passing hole 11C in the base 1A for accommodating and fixing the socket 12A in a secured position, and an embedding groove 121A is disposed in the middle section of the ring in the socket to provide latching after the lamp rod 2 passes through. An upper cover 3 is set on the top of the base 1A, and a ringed concession 13A is disposed on the base proximate to the outer ring for the pressing and positioning of the protrusion 31 in order to assist the blocking of the lamp rod 2. A through hole is set on the lateral side of the base 1A and a fixing hole 32 on the position of the through hole 14A of the base corresponsive to the lateral side of the upper cover 3 for the screw bolt P to be secured on the fixing hole 32 and the through hole 14A of the base, so that the upper cover can be fixed on the top of the base 1A.

A coupling sleeve 21A is soldered at the top section of the lamp rod 2, and the coupling sleeve 21A superimposes on the L-shape bracket 211A on the ring of the embedding groove 121A of the socket. When the lamp rod 2 is inserted, the bracket 211A is compressed in advance; after the lamp rod 2 passes the embedded groove 121A, the bracket flips out to an appropriate extent and is latched, into the embedding groove 121A of the socket 12A to fix the lamp rod 2 and the base 1A in a secured position. A pair of grooves 212A on the ringed concession of the base is disposed on an end of the fixing sleeve 21A. After the fixing sleeve 21A is inserted into the base, the upper cover 3 exactly covers the top of the base 1A, and the protrusion 31 exactly presses against the top of the groove 212 of the fixing sleeve, such that the top of the upper cover 3 and the top of the base 1A are of the same height in order to definitely inserts the lamp rod 2 into the interior of the base 1A.

Please refer to FIG. 5B for the third preferred embodiment of the present invention, wherein the base 1A has a male screw thread surface 15A on the outer ring, and a corresponsive female screw thread surface 33 is set at the inner ring such that when the lamp rod 2 is inserted by the fixing the fixing sleeve 21A onto the through hole 11A of the base 1A, the upper cover 3 can be secured onto the base 1A directly so that the protruded ring 31 of the upper cover 3 exactly presses against the top of the groove 212A of the fixing sleeve 21A in order to secure the position of the lamp rod 2 into the base 1A.

Please refer to FIG. 5C for the fourth preferred embodiment of the present invention, wherein the base 1 has a contracted neck section 16A at an appropriate position on the ring surface, and the through hole 11A of the base 1A just forms a passage from the ringed rim of the contracted neck section 16A to the exterior, and the contracted neck section 16A at the external side of the through hole 11A has a curved spring 161A, and the lamp rod has an aslant bracket 213A on the fixing sleeve 21A. After the lamp rod 2 is inserted into the base 1A, the outwardly inclined end of the bracket 213A just latches the bottom edge of the spring 161A to assure the secured insertion of the lamp rod 2 into the base 1A in order to reduce the volume for transportation and storage, and attains the function of making the DIY assembling more convenient to users.

Figure 6A:
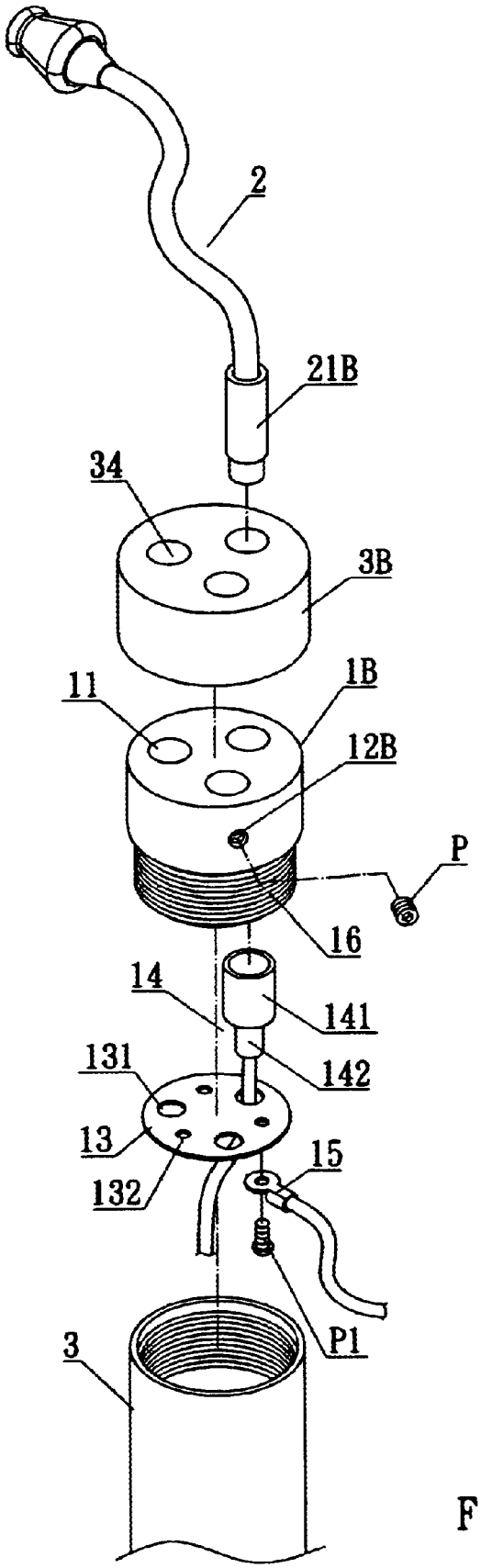
FIG. 6A is a diagram of a fifth preferred embodiment of the present invention.

Please refer to FIG. 6A for the fifth preferred embodiment of the present invention, wherein the base 1B has a plurality of upper and lower stairway-like through hole 11 in the base 1B, and the through hole with larger stairway-like hole is just large enough for the socket 14 to pass through, and the through hole 11B with smaller stairway-like hole is just large enough to let the connector 21B of the lamp rod 2 pass through, and the base 1B has a screw hole 12B at the ring of each of the corresponding through holes 11 to provide a restricting screw bolt P to be secured and tightly presses on the connector 21B. A penetrating hole 34 is disposed on the corresponding through hole of the base on the upper cover 3B, so that after the lamp rod 2 is inserted, the end of the connector 21B slightly protruded from the bottom of the lamp rod 2 can be exactly inserted into the socket 14 of the base 1, and the base 1B is electrically connected, in order to assure that the lamp rod 2 is securely inserted into the base 1B.

Please refer to FIG. 6B for the sixth preferred embodiment of the present invention, wherein the interior of the base 1C has a plurality of upper and lower penetrating stairway-like through holes 11D, and a protruded restricting groove C111 is disposed each on both sides of each through hole 11D for exactly insert the socket 14 into the through hole 11D with the larger stairway-shaped hole for the positioning, and the lamp rod 2 has a ring 22 on the external protruded ring of the base corresponding to the lamp rod 2 and an embedding member 23 corresponsive to the restricting groove C111. After the lamp rod 2 is inserted into the top of the base 1C, the embedding member 23 just subsides into the restricting groove 11B of the base 1C to prevent the lamp rod from rotating, and the ring 22 of the lamp rod 2 is latched to the top of the base 1C to prop the lamp rod 2 to prevent the lamp rod from falling.

Please refer to FIG. 6*c* for the seventh preferred embodiment of the present invention, wherein the base id has a conical neck section 161*d* at the top of the external screw thread section 16*d*, and the conical neck section 161*d* superimposes

What is claimed is:

1. A do-it-yourself lamp structure, comprising of a base and a hollow lamp rod on the base; wherein an interior of the base having upper and a lower stairway-shaped through holes, such that a socket being exactly inserted into a through hole with a larger stairway-shaped hole for-the positioning, and the a through hole with a smaller stairway-shaped hole for letting a connector of the lamp rod to pass through; the smaller stairway-shaped hole being substantially a C-shape hole, having an embedding groove protruded from the a side of a ring, and a latching hole leading to an exterior being disposed at the a bottom of the embedding groove;

a positioning disc, disposed at a bottom of the base, having a smaller diameter with respect to the position of the through hole of the base, and a penetrating hole of a socket being latched into such through hole, and a fixing hole being disposed between the through holes to let a ground line pass through, and a fixing screw bolt passing through a bottom of the fixing hole of the positioning disc and being fixed on the bottom of the base; after the positioning disc is fixed, a stairway-shaped edge of the socket being latched to the positioning disc to prevent the socket from falling off, and a socket with a larger ring being located in the through hole of the base, and a smaller ring being protruded from the bottom of the positioning disc; and an external screw thread section of a fixing tube of the lamp base being disposed at the bottom of the base; and, a fixing sleeve, soldered at a top of the lamp rod, substantially a pair of small stairway-like C-shaped rods, for preventing the lamp rod at the base from rotating in the small stairway-shaped hole; a bracket being extended outward from the ring at the position of the embedding groove of the base corresponsive to the fixing sleeve, and after the lamp rod is inserted, the bracket being flipped out, and latched to the latching hole of the base to assure the secure position of the lamp rod and the base; a socket at the bottom of the lamp rod being slightly protruded from the bottom of the lamp rod, and the end of the socket inserted into the socket of the base, and the base being electrically coupled;.

2. A The do-it-yourself lamp structure as claimed in claim 1, wherein the lamp rod has a curved spring inwardly bent towards both sides of a bottom surface of the fixing sleeve, such that, after the lamp rod is sleeved, the lamp rod and an inner edge of the fixing sleeve are separated by the curved spring to form a ringed space for facilitating the soldering and coupling of the lamp rod and fixing sleeve.

3. The do-it-yourself lamp structure as claimed in claim 1, wherein the lamp rod passes into the latching hole of the base by a tool in advance, whenever the lamp rod is pulled out from the base, such that the bracket latched in the latching hole is compressed inwardly to let the lamp rod be pulled out.

4. A hollow lamp rod and base coupling structure, comprising a base, and a hollow lamp rod assembled onto the base, wherein a through hole is disposed in the base for coupling a socket, and an embedding groove is disposed at a middle section of a side ring of the socket for letting the lamp rod be passed through and fixed into the position; said hollow lamp rod having a fixing sleeve soldered onto a head of the lamp rod for coupling to a through hole of the base, and a fixing sleeve having a L-shaped bracket disposed at a ring of an embedding groove of the socket, and a bracket being compressed before the lamp rod is inserted, and flipping out to let the lamp rod pass through and latches into a latching hole of the base; further comprising an upper cover at a top of the base, and a ringed concession disposed at the top of the base proximate to the outer ring, an end of the fixing sleeve of the lamp rod having a groove corresponding to the ring concession of the base, such that, after the fixing sleeve is inserted into the base, a protruded ring of the upper cover is pressed against the ringed concession of the base and presses against an upper section of the groove of the fixing sleeve for assisting the positioning of the lamp rod.

5. The lamp rod and base coupling structure as claimed in claim 4, wherein the said base has a penetrating hole at the lateral side of the base, and a fixing hole disposed at a position of the through hole of the base on the lateral side of the upper cover for letting a screw bolt pass through the penetrating hole of the base from an outer side of the fixing hole in order to fix the upper cover to the top of the base.

6. A hollow lamp rod and base coupling structure, comprising a base, and a hollow lamp rod assembled onto the base, wherein a through hole is disposed in the base for coupling a socket, and an embedding groove is disposed at a middle section of a side ring of the socket for letting the lamp rod be passed through and fixed into the position; said hollow lamp rod having a fixing sleeve soldered onto a head of the lamp rod for coupling to a through hole of the base, and a fixing sleeve having a L-shaped bracket disposed at a ring of an embedding groove of the socket, and a bracket being compressed before the lamp rod is inserted, and flipping out to let the lamp rod pass through and latches into a latching hole of the base; wherein the base has a contracted neck section on the ring surface, the fixing hole of the base letting a ring of the contracted neck section be led to the outside, and a curved spring is latched on an outer side of the fixing hole; an aslant bracket being disposed on the fixing sleeve such that, after the lamp rod is inserted into the base, an external inclined end of the bracket latches to a bottom of the spring to assure that the lamp rod is fixed into the base.

7. A hollow lamp rod and base coupling structure, comprising a base, and a hollow lamp rod assembled onto the base, wherein a through hole is disposed in the base for coupling a socket, and an embedding groove is disposed at a middle section of a side ring of the socket for letting the lamp rod be passed through and fixed into the position; said hollow lamp rod having a fixing sleeve soldered onto a head of the lamp rod for coupling to a through hole of the base, and a fixing sleeve having a L-shaped bracket disposed at a ring of an embedding groove of the socket, and a bracket being compressed before the lamp rod is inserted, and flipping out to let the lamp rod pass through and latches into a latching hole of the base; wherein the base has a male screw thread surface on an outer ring of the base, and a female screw thread surface on the inner ring of the base, such that, after the lamp rod is inserted into the fixing hole of the base corresponding to the fixing sleeve, an upper cover being fixed into a top of the base and letting a protruded ring of the upper cover pass against the upper section of the groove of the fixing sleeve to assure that the lamp rod is fixed into the base.

8. A do-it-yourself lamp structure, comprising a base and a hollow lamp rod assembled on the base, wherein the base has a plurality of upper and lower penetrating stairway-shape fixing holes in an interior, a socket inserted into the fixing hole with larger stairway-shaped hole for the positioning, the fixing hole with smaller stairway-shaped hole for passing a connector for the lamp rod, a fixing disc being disposed at the position of the fixing hole of the base with a smaller diameter, and a penetrating hole being latched by a socket, and a coupling hole being disposed between penetrating holes for letting a ground line pass through a screw bolt in advance and then through a bottom of the coupling hole of the fixing disc and being fixed onto the bottom of the base, such that, after a positioning disc is latched to prevent the socket from falling off, the socket with larger ring being is exactly located in the through hole of the base, and a smaller ring protrudes from a bottom of the positioning disc; an external screw thread section is set on a bottom of the base; said lamp rod at a bottom having a connector, an end of the connection protruding from a bottom of the lamp rod, such that, after the lamp rod is inserted, the connector protruding from the bottom of the lamp rod is inserted into the socket of the base.

9. The do-it-yourself lamp structure as claimed in claim 8, wherein the base has a restricting groove protruded from both sides of each through hole of the base, and a through hole with a smaller diameter being disposed at the position of the through hole of the base and the center of the positioning disc, and the socket being latched into the through hole, such that, after the ground line being passed through the fixing bolt in advance, a bottom of the penetrating hole at the center of the positioning disc being passed through and latched onto the bottom of the base.

10. The do-it-yourself lamp structure as claimed in claim 8, wherein the base has a spiral through hole disposed on the ring of the fixing hole of the base to let the screw bolt press against the connector.

11. The do-it-yourself lamp structure as claimed in claim 8, wherein the base has a cap at a top of the base, with a through hole being disposed on the fixing hole of the base to cover the restricting bolt to prevent the bolt from falling off.

12. The do-it-yourself lamp structure as claimed in claim 8, wherein the base has a conical neck section at the a top of the external screw thread section of the base, and a spiral through hole each disposed at a ring edge of each through hole to let the screw bolt be latched and tightly coupled to the connector.

13. The do-it-yourself lamp structure as claimed in claim 8, wherein the base, positioning disc, socket and ground line is assembled, and the external screw thread section at the bottom of the base being fixed to the fixing pipe of the wall lamp, floor lamp, or suspending lamp as different requirements of use.

14. The lamp rod and base coupling structure as claimed in claim 4, wherein the base has a male screw thread surface on an outer ring of the base, and a female screw thread surface on an inner ring of the base, such that, after the lamp rod is inserted into the fixing hole of the base corresponding to the fixing sleeve, the upper cover is fixed into the top of the base and the protruded ring of the upper cover presses against the upper section of the groove of the fixing sleeve to assure that the lamp rod is fixed into the base.

* * * * *